US006397873B1

(12) United States Patent
Rozeboom et al.

(10) Patent No.: US 6,397,873 B1
(45) Date of Patent: Jun. 4, 2002

(54) METHOD AND APPARATUS FOR TEMPORARILY INCREASING THE TRANSPORT CAPACITY OF THE WATER SUPPLY SYSTEM IN CASE OF A CALAMITY

(75) Inventors: Robert Henry Rozeboom, Soest; Petrus Jacobus Ruiter, Utrecht, both of (NL)

(73) Assignee: N.V. Waterleidingsbedri JF Midden Nederland, Utrecht (NL)

( * ) Notice: Subject to any disclaimer, the term of this patent is extended or adjusted under 35 U.S.C. 154(b) by 0 days.

(21) Appl. No.: 09/500,684

(22) Filed: Feb. 9, 2000

(30) Foreign Application Priority Data

Feb. 11, 1999 (NL) ..... 1011275

(51) Int. Cl.[7] ..... E03B 5/00
(52) U.S. Cl. ..... 137/1; 137/565.3; 417/234
(58) Field of Search ..... 137/899.4, 565.19, 137/565.3, 1; 417/234

(56) References Cited

U.S. PATENT DOCUMENTS

| | | | | |
|---|---|---|---|---|
| 1,718,178 A | * | 6/1929 | Oliphant | 137/899.4 X |
| 1,873,045 A | * | 8/1932 | Saathoff | 137/565.3 X |
| 1,891,408 A | * | 12/1932 | Gorman | 417/234 X |
| 1,922,437 A | * | 8/1933 | Himberger | 417/234 |
| 2,309,415 A | * | 1/1943 | Pearson et al. | 137/565.3 X |
| 2,455,271 A | * | 11/1948 | Raymond | 137/565.19 X |
| 2,789,756 A | * | 4/1957 | Allen | 137/899.4 |
| 3,266,428 A | * | 8/1966 | Feith et al. | 417/234 X |
| 3,584,640 A | | 6/1971 | Chapman | |
| 3,867,070 A | * | 2/1975 | Sloan | 417/234 X |
| 4,070,135 A | * | 1/1978 | Eller | 417/234 |
| 5,419,497 A | * | 5/1995 | Warrington | 417/234 X |

FOREIGN PATENT DOCUMENTS

| | | |
|---|---|---|
| DE | 195 10 409 A | 9/1996 |
| JP | 60-128979 | 1/1994 |

OTHER PUBLICATIONS

Murphy, Maripat, "Weathering the Storm: Water Systems Versus Hurricanes," American Water Works Association Journal, Jan., 1994, pp. 74–83.

* cited by examiner

*Primary Examiner*—John Rivell
(74) *Attorney, Agent, or Firm*—Varnum, Riddering, Schmidt & Howlett LLP

(57) ABSTRACT

Method and apparatus for temporarily increasing the transport capacity of the water supply system in case of a calamity, in which despite the occurrence of a calamity an amount of drinking water is to be transported to the service area of a pumping station or transport line which has failed.

In case of a calamity, at least one mobile apparatus for raising the pressure in the transport line is temporarily connected to the residual supply system to take over the failing transport function.

The apparatus has a transportable housing with a pump coupled to a motor, comprising means for setting the pump on two sides into communication with a water transport line via connecting lines, and has a capacity sufficient for deployment in a municipal, regional or still larger water supply system.

4 Claims, 2 Drawing Sheets

METHOD AND APPARATUS FOR TEMPORARILY INCREASING THE TRANSPORT CAPACITY OF THE WATER SUPPLY SYSTEM IN CASE OF A CALAMITY

This invention relates to a method and apparatus for temporarily increasing the transport capacity of the water supply system in case of a calamity, in which despite the occurrence of a calamity an amount of drinking water is to be transported to the service area of a pumping station or transport line which has failed.

For customers served by waterworks, it is of vital importance that during the occurrence of any calamity, the level of supply remains above a certain minimum. To that end, in the Netherlands, the VEWIN standards have been established.

The guideline for supply assurance as drawn up by the VEWIN reads: In case of failure of one element of the drinking water system, in centers of consumption, the residual supply capacity of the system must, on a daily basis, be greater than 75% of the maximum daily capacity. A calamity is defined as the failure of one element which cannot be repaired within 24 hours and has an effect on a large group of consumers.

To meet this requirement, waterworks must make provisions that make it possible to continue to supply drinking water during the protracted failure of a pumping station or transport line. In case of a calamity, therefore, an amount of drinking water must be transported to the service area of the pumping station or transport line which has failed.

The transport capacity of the residual mains system should then be anticipatorily increased if it is too small to enable supply of the required amount for supply assurance.

To solve this problem, for instance an additional transport line can be installed or an ancillary line with segmentation can be laid. However, both solutions are costly and disadvantageous to the water quality in the normal supply situation.

What may also be considered is to permanently arrange a fixed apparatus at a certain location for raising the pressure in the line and to connect it to the transport line. Thus, the transport function of the failing pumping station or pipe section can be partly taken over.

However, since in that case a large number of fixed apparatuses are needed, which moreover are not used in the normal supply situation, this solution is expensive and not economical.

The object of the invention is to provide a method and apparatus with which the drawbacks outlined are obviated. This object is achieved with a method wherein in case of a calamity at least one mobile apparatus for raising the pressure in the transport line is temporarily connected to the residual supply system, and with a mobile apparatus, evidently intended for and arranged for use in that method, having a transportable housing with a pump coupled to a motor comprising means for setting the pump on two sides into communication with a water transport line via connecting lines.

It is possible during a calamity to make a location suitable for receiving a mobile apparatus according to the invention. Preferably, a transport function which has fallen out is taken over, while in a relatively inexpensive manner a mobile apparatus according to the invention, which can be conveyed in a short time to predetermined locations and which can be rapidly connected to the water transport line in question, suffices.

It is noted that German Offenlegungsschrift 195 10 409 discloses an apparatus for increasing the pressure in a pipe system, which apparatus comprises a number of pumps, to be pre-mounted on a plate, if desired. The advantage of this apparatus is supposed to be that parts of the apparatus are easy to mount and dismount. It seems, however, that this advantage relates solely to the parts of an apparatus which itself forms part of a larger machine. No reference is made to a mobile apparatus for temporary use in a system of water transport lines.

It is further noted that U.S. Pat. No. 3,584,640 discloses a pneumatic water pump station comprising a housing with a pump coupled to a motor, arranged in a water reservoir. It is stated that the pump station is compact and easily transportable. The pump station is intended as an alternative to a water tank or pressure-water installation, which have a fixed function within a drinking water system. Although the pump station may in itself be easily transportable, it is intended for use in a permanent setup. Such a pump station with built-in water reservoir is not suitable as a mobile booster in the use of the method according to the invention.

It is noted, finally, that Patent Abstract of Japan, vol. 009, no. 290 (M-430) concerning the Japanese patent application with publication no. 60128979, discloses a high pressure pump on wheels, with a suction piece to be inserted in a storage tank and a high pressure conduit that can be connected to an injection nozzle or the like. As application for raising water pressure in a transport line of a water supply system, such a mobile pump is not suitable.

The invention will now be further elucidated hereinafter in the following description and with reference to the drawings.

Figure 1:
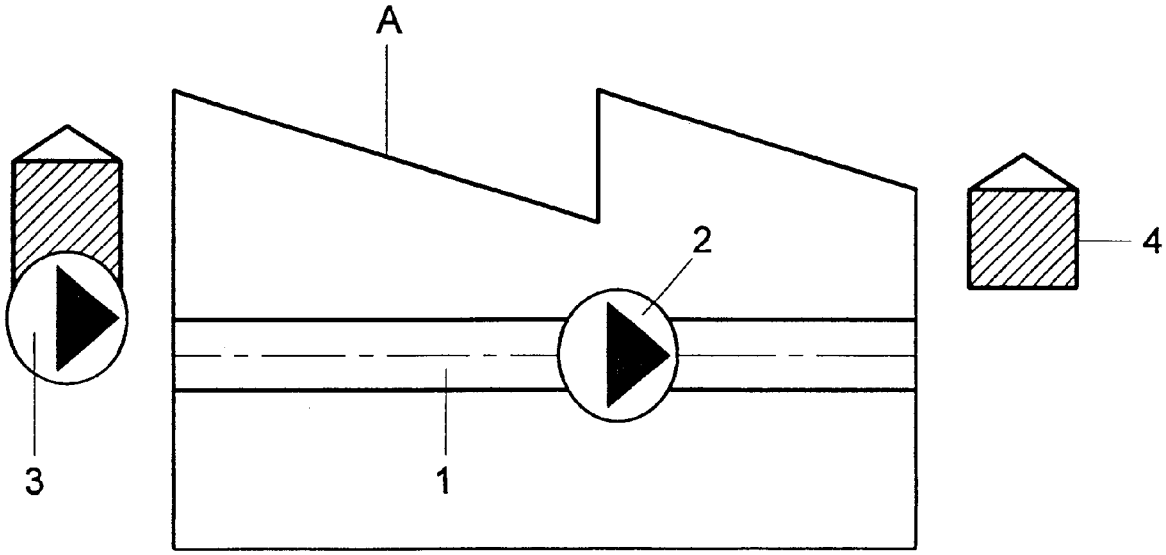
FIG. 1 shows a diagram of the method according to the invention.

Referring to FIG. 1, there is schematically shown a transport line 1, where temporarily at least one (schematically represented) mobile apparatus 2 for raising the pressure is placed.

The line 1 passes from a pumping station 3 to customers 4 who are to receive a sufficient volume flow of water.

Further, a pressure line A is shown, which reflects the course of the pressure and exhibits a descending course from the pumping station 3 to the mobile apparatus 2, exhibits a rise at the mobile apparatus 2, and proceeds to reflect a descending course again towards the customers 4.

Figure 2:
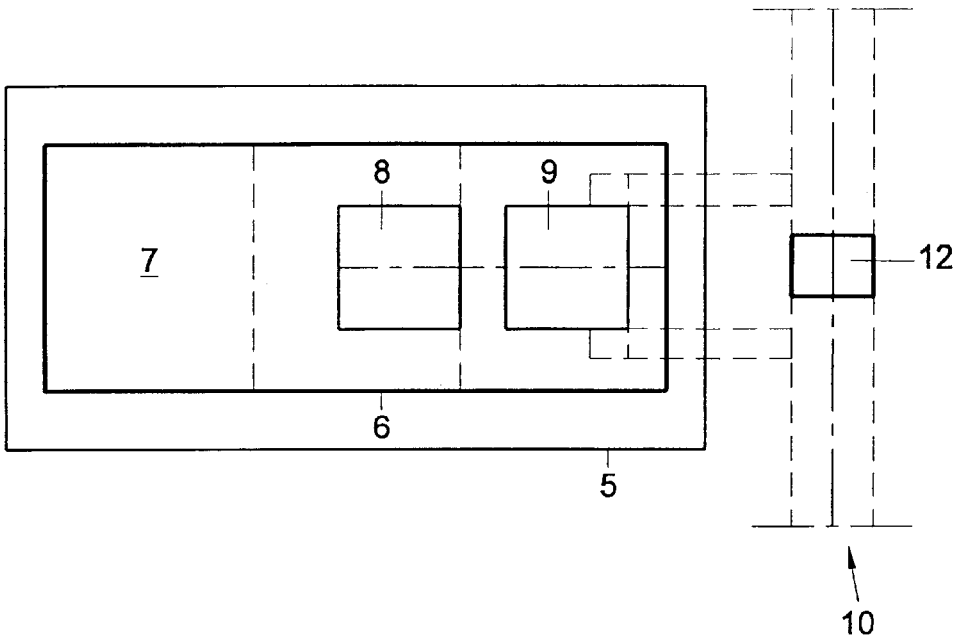
FIG. 2 shows a top plan view of an apparatus according to the invention, for use in the-method according to the invention.

In FIG. 2, a setup platform 5 is shown, on which in case of a calamity at least one mobile apparatus 2 according to the invention for raising the pressure is placed.

The mobile apparatus 2 comprises a housing 6, a fuel supply 7, a motor 8, which is coupled to a pump 9, which communicates on two sides with, a transport line 10 via connecting lines 11. In the transport line 10, a valve 12 is included. It will be clear that the mobile apparatus according to the invention must have a large capacity, suitable for a water supply system. The capacity is preferably regulable. Water supply system is herein understood to mean a system suitable for transporting water, such as drinking water, demineralized water, crude water or household water. The water supply system can function on a municipal, regional or higher level.

Figure 3:
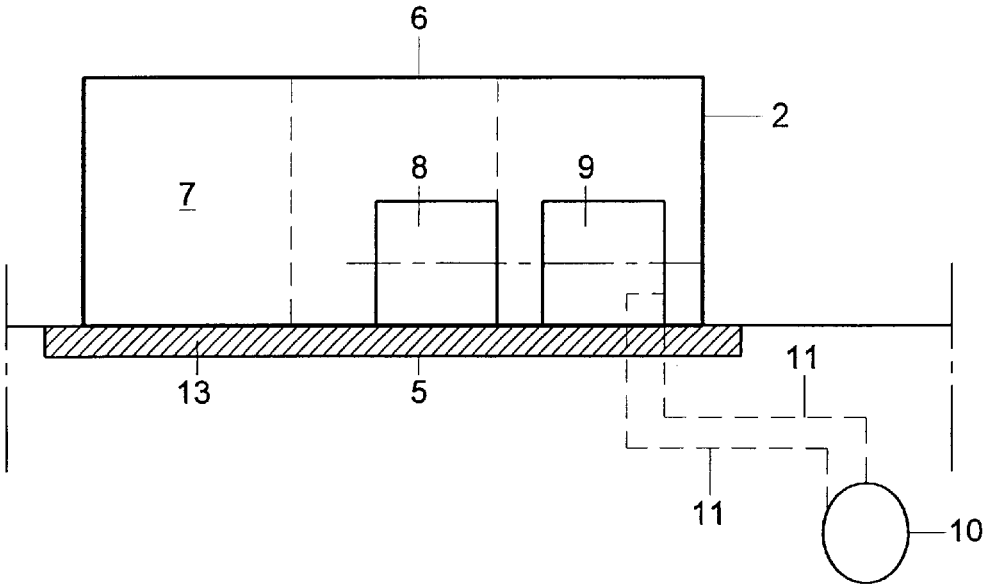
FIG. 3 shows a side elevation of such an apparatus.

In FIG. 3, where the same reference numerals are used as in FIG. 2 to indicate the same parts, the arrangement is shown in side elevation. The housing 6 further comprises at least one door (not shown). The housing 6, upon being placed (e.g. by means of a crane) on the setup platform, is, if necessary, fixed by means of a device suitable for the purpose, such as a fixing frame, and locked. For the sake of clarity, the fixing frame is not shown. Further shown is a concrete slab 13 for support. It will be clear to those skilled in the art, however, that, depending on the soil composition, such support does not always need to be present.

In an advantageous embodiment, the pump is placed in the housing such that it is possible to couple it to the transport line having, for instance a diameter of 400 mm by means of flexible conduits having, for instance, a diameter of 250 mm, and rapid couplings. This has as an advantage that the direction of flow can be reversed so that a setup position can be saved.

It is noted that supply in two directions may be necessary, for instance, when two service areas can be of mutual help through a supply in case of a calamity.

Deployment of a mobile apparatus in the event of a calamity proceeds as follows: To restore supply assurance, the necessary measures are implemented at the pumping stations and in the pipeline system. For instance, the link-up of an additional pump. The mobile apparatus is transported from its stand to the setup position and connected. The mobile apparatus can, when it is in operation, remain on the means of transport. A number of valves in the transport line system are closed and/or opened and the mobile apparatus starts to pump the drinking water, with the first water being discharged to prevent water quality problems, Then a start is made with remedying the calamity. Deployment of the mobile apparatus is supervised by persons trained for the purpose. After the calamity has been remedied, the mobile apparatus is transported to its stand. The mobile apparatus is checked there, so that it is ready for a next calamity.

Optionally, the mobile apparatus according to the invention can be used for draining work and when lines are temporarily taken out of operation. For proper management and maintenance, the mobile apparatus according to the invention must be regularly submitted to test runs. This can he done by giving the mobile apparatus a fixed stand on the site of a pumping Station and connecting it there to a transport line, a loose water tank or a built-in water tank.

Further, it is possible to optionally use the mobile apparatus for pumping other matter than water in a pipe system.

What is claimed is:

1. A method for temporarily increasing the transport capacity of the water supply system in case of a calamity, in which despite the occurrence of a calamity an amount of drinking water is to be transported to the service area of a pumping station of transport line which has failed, characterized in that in cage of a calamity at least one mobile apparatus for raising the pressure in the transport line is temporarily connected to the residual supply system.

2. A method according to claim 1, characterized in that the transport line in which pressure is to be increased is provided at a number of predetermined locations with a setup position on which the mobile apparatus can be placed and connected.

3. A method according to claim 1, characterized in that the mobile apparatus comprises a housing in which a pump with drive is placed, as well as an energy supply, a control and a connection to the transport line.

4. Mobile apparatus for temporarily increasing transport capability of an identified area of a water supply system for supplying drinking water to a designated service area, said water supply system including at least one pumping station and water transport lines connectable to said pumping station for transporting drinking water to said designated service area, said mobile apparatus comprising:

a pump having two sides;

connecting lines for setting said two sides of said pump in communication with said transport lines in case of an emergency due to failure of one of said at least one pumping station and said water transport line; and a motor for driving said pump for raising pressure in said transport line.

* * * * *

UNITED STATES PATENT AND TRADEMARK OFFICE

CERTIFICATE OF CORRECTION

PATENT NO. : 6,397,873 B1
DATED : July 25, 2002
INVENTOR(S) : Rozeboom, Robert H.

It is certified that error appears in the above-identified patent and that said Letters Patent is hereby corrected as shown below:

Column 4,
Line 10, please delete the word "of" and replace it with the word "or".

Signed and Sealed this

Nineteenth Day of November, 2002

*Attest:*

*Attesting Officer*

JAMES E. ROGAN
*Director of the United States Patent and Trademark Office*